US007383952B2

(12) United States Patent
Kruelle et al.

(10) Patent No.: US 7,383,952 B2
(45) Date of Patent: Jun. 10, 2008

(54) CORNER OR EDGE PROTECTOR EXHIBITING IMPROVED FLEXURAL STRENGTH AND RESISTANCE PROPERTIES

(75) Inventors: John Kruelle, Glendale, AZ (US); Jerry Robin Hayes, Florence, SC (US)

(73) Assignee: Illinois Tool Works Inc., Glenview, IL (US)

( * ) Notice: Subject to any disclaimer, the term of this patent is extended or adjusted under 35 U.S.C. 154(b) by 375 days.

(21) Appl. No.: 11/115,355

(22) Filed: Apr. 27, 2005

(65) Prior Publication Data

US 2006/0243621 A1 Nov. 2, 2006

(51) Int. Cl.
*B65D 81/02* (2006.01)

(52) U.S. Cl. ..... 206/453; 206/586

(58) Field of Classification Search ..... 206/320, 206/326, 453, 586, 597; 229/199; 217/66, 217/67, 69; 248/345.1
See application file for complete search history.

(56) References Cited

U.S. PATENT DOCUMENTS

| | | | | |
|---|---|---|---|---|
| 749,834 | A | | 1/1904 | Beisel |
| 2,004,626 | A | | 6/1935 | Hann |
| 2,266,181 | A | | 12/1941 | Epps |
| D192,385 | S | | 3/1962 | Anderson |
| 3,049,260 | A | | 8/1962 | Stone |
| 3,073,439 | A | | 1/1963 | Symmonds, Jr. |
| 3,152,693 | A | | 10/1964 | Anderson |
| 3,199,709 | A | | 8/1965 | Morrison et al. |
| 3,203,726 | A | | 8/1965 | Smith |
| 3,416,652 | A | | 12/1968 | Almasy |
| 3,536,245 | A | | 10/1970 | Palmer |
| D225,829 | S | | 1/1973 | Szabo |
| 3,908,850 | A | | 9/1975 | Jureit et al. |
| 3,955,677 | A | | 5/1976 | Collingwood |
| 4,120,441 | A | * | 10/1978 | Hurley ..... 206/586 |
| 4,201,138 | A | | 5/1980 | Cox |
| 4,202,449 | A | | 5/1980 | Bendt |

(Continued)

FOREIGN PATENT DOCUMENTS

| | | |
|---|---|---|
| FR | 2624103 | 6/1989 |

(Continued)

*Primary Examiner*—David T Fidei
(74) *Attorney, Agent, or Firm*—Steven W. Weinrieb

(57) ABSTRACT

A new and improved external corner protector is fabricated from predetermined materials and comprises a vertex portion, and a pair of leg members which diverge outwardly at a predetermined included angle with respect to each other from the vertex portion. The vertex portion and distal end portions of the leg members have relatively enlarged cross-sectional dimensions relative to the cross-sectional dimensions comprising those portions of the leg members which integrally interconnect the distal end portions of the leg members to the vertex portion, wherein the relatively enlarged cross-sectional dimensions serve to reinforce the vertex portion and to dispose only such relatively enlarged distal end portions of the leg members into contact with the external side wall members of the palletized load which define the external corner region being protected. In this manner, the leg members of the external corner protector are flexed more than has conventionally been the case such that forces are generated and transmitted to the vertex portion so as to rigidify the same whereby the vertex portion will exhibit enhanced flexural strength and bending resistance properties with respect to external forces which may be impressed upon the external corner protector thereby tending to flex or bend the same.

20 Claims, 2 Drawing Sheets

U.S. PATENT DOCUMENTS 4,244,471 A 1/1981 Plante
4,265,184 A 5/1981 Cox
4,292,901 A 10/1981 Cox
4,399,915 A 8/1983 Sorenson
4,482,054 A 11/1984 Gardner
4,483,444 A * 11/1984 Gardner ..... 206/594
4,496,054 A 1/1985 Koltun
4,714,163 A 12/1987 Reeves
4,742,916 A * 5/1988 Galea ..... 206/586
4,771,893 A 9/1988 Liebel
4,871,063 A 10/1989 Kumbier
4,874,095 A 10/1989 Warych
4,877,673 A 10/1989 Eckel et al.
4,899,888 A 2/1990 Shawler
4,925,512 A 5/1990 Briand
5,040,684 A 8/1991 Knowles
5,048,689 A 9/1991 McFarland
5,056,664 A 10/1991 Demers
5,131,541 A 7/1992 Liebel
5,161,692 A 11/1992 Knierim
5,175,041 A 12/1992 Webb et al.
5,181,611 A 1/1993 Liebel
D336,033 S 6/1993 Welsh
5,267,651 A * 12/1993 Hughes ..... 206/586
5,277,310 A 1/1994 Mertz
5,307,928 A 5/1994 Bishop
5,385,236 A * 1/1995 Cowan et al. ..... 206/453
5,813,537 A 9/1998 Dereu et al.
5,918,800 A * 7/1999 Goshorn et al. ..... 229/199
6,234,314 B1 5/2001 Qiu et al.
6,464,080 B1 * 10/2002 Morris et al. ..... 206/591
6,520,336 B2 2/2003 Baechle
6,527,119 B1 3/2003 Markert et al.

FOREIGN PATENT DOCUMENTS

JP 5-170264 7/1993

* cited by examiner

CORNER OR EDGE PROTECTOR EXHIBITING IMPROVED FLEXURAL STRENGTH AND RESISTANCE PROPERTIES

FIELD OF THE INVENTION

The present invention relates generally to external corner or edge protectors for protecting the external corner or edge regions of packages, articles, products, palletized loads, and the like, and more particularly to a new and improved external corner or edge protector which not only protectively surrounds or envelops an external corner or edge region of a package, article, product, palletized load, or the like, but in addition, is fabricated from predetermined materials, and is uniquely structured so as to facilitate either a reduction in the amount of material required in order to fabricate the external corner or edge protector whereby the flexural strength or resistance properties of the external edge or corner protector can be preserved as compared to conventional external corner or edge protectors, or alternatively, the new and improved external edge or corner protector can be fabricated from suitable materials having volume and weight parameters comparable to those of conventional external corner or edge protectors whereby, as a result of the aforenoted unique structure, the flexural strength or resistance properties of the external edge or corner protector can be enhanced as compared to conventional external edge or corner protectors.

BACKGROUND OF THE INVENTION

External package, article, product, or palletized load corner or edge protectors, corner post supports, and the like, are of course well-known in the packaging, shipping, and transportation industries, and are accordingly widely used in connection with the packaging, shipping, and transportation of various packages, articles, products, palletized loads, and the like, wherein it is particularly desirable to protect the external corner or edge portions or regions of the packages, articles, products, palletized loads, or the like, during transit. Typical or conventional external corner or edge protectors, which may be used upon various packages, articles, palletized loads, products, and the like, are disclosed, for example, within U.S. Pat. No. 5,918,800 which was issued to Goshorn et al. on Jul. 6, 1999, U.S. Pat. No. 5,385,236 which was issued to Cowan et al. on Jan. 31, 1995, U.S. Pat. No. 5,181,611 which was issued to Liebel on Jan. 26, 1993, U.S. Pat. No. 4,877,673 which was issued to Eckel et al. on Oct. 31, 1989, U.S. Pat. No. 4,742,916 which was issued to Galea on May 10, 1998, and U.S. Pat. No. 4,202,449 which was issued to Bendt on May 13, 1980. As can readily be seen from, for example, the aforenoted patents to Goshorn et al., Cowan et al., Liebel, Eckel et al., and Bendt, after the external corner or edge protectors have been conventionally applied to, or mounted upon, the external corner or edge portions of a particular palletized load, package, article, product, or the like, the external corner or edge protectors are subsequently secured upon the package, article, product, palletized load, or the like, by means of suitable package strapping, lashing, stretch film, ropes, bands, or the like. It can therefore be appreciated that, in order to preserve the structural integrity of the strapped or banded package, article, product, palletized load, or the like, it is imperative that the structural integrity of the external corner or edge protector is itself preserved in connection with, for example, flexural or bending forces which are oriented or impressed upon the external corner or edge protectors in directions substantially perpendicular to the longitudinal axis, or longitudinal extent, of the external corner or edge protectors by means of the aforenoted strapping, lashing, ropes, stretch film, bands, or the like. If this was not the case, that is, if the structural integrity of the external corner or edge protectors was not in fact preserved, and was in fact compromised, then obviously, the utility or usefulness of the external corner or edge protectors, with respect to the protection of the external corner or edge portions of the packages, articles, products, palletized loads, or the like, would likewise be compromised.

Continuing further, various factors influence or determine the flexural properties, or flexural strength or resistance values, characteristic of an external corner or edge protector. For example, one critically important factor which influences or determines the flexural properties, or flexural strength or resistance values, characteristic of an external corner or edge protector, comprises the material from which the external corner or edge protector is fabricated, and in addition, whether or not such external corner or edge protector has a solid or substantially hollow structure. For example, as can be appreciated from the aforenoted patent which was issued to Liebel, the corner post disclosed within such patent is fabricated from laminated paperboard, and in addition, the corner post has a paperboard spine, which substantially comprises a hollow structure formed by folding end portions thereof back upon themselves, secured to the external surface of the corner post per se. In view of the fact that the corner post and spine components are fabricated from paperboard, their flexural resistance properties would probably not be as high as may be expected if the corner post and spine components were fabricated from other more rigidified materials, and in addition, if such structural components were exposed to moist conditions, which may develop or prevail within different cargo holds, or as a result of having particular products disposed internally within the packages, palletized loads, or the like, the structural integrity of the corner post and spine components could be jeopardized.

Still further, the fact that external corner or edge protectors may be fabricated from other materials may likewise provide such external corner or edge protectors with desirable shock absorption or cushioning properties, but, again, they may not provide such external corner or edge protectors with the desired flexural resistance properties. It is seen, for example, that the external corner or edge protectors of Galea are fabricated from molded fiber or pulp material, while the external corner or edge protector of Cowan et al. is fabricated from a combination of a soft thermoplastic material, such as, for example, low density polyethylene, for its cylindrical members, and a rigid thermoplastic material, such as, for example, high density polypropylene, for its connecting web members. As can therefore be readily appreciated, not only is the particular type of material, from which the external corner or edge protector structural components are fabricated, critically important in connection with the various structural and lifetime service qualities exhibited by the external corner or edge protectors, but in addition, the amount and weight of the material required to fabricate such external corner or edge protector structural components is also a critically important factor to be considered from a manufacturing cost-effective or economically viable point of view. It would therefore be desirable to fabricate an external corner or edge protector which could not only exhibit, for example, flexural strength or bending resistance qualities which would be comparable to those of conventional external corner or edge protectors, but in addition, could effectively be fabricated with a predeterminedly reduced amount of material or weight, or alternatively, it would be desirable to fabricate an external corner or edge protector which, for a predetermined amount of material and weight, could exhibit flexural strength or resistance properties which would exceed those of conventional external corner or edge protectors.

A need therefore exists in the art for a new and improved external corner or edge protector, for protecting the external corner or edge region of a package, article, product, palletized load, and the like, wherein the amount of material that is required in connection with the manufacture or fabrication of such an external corner or edge protector could be substantially reduced as compared to conventional external corner or edge protectors, but still further, the external corner or edge protector would be provided with unique and novel structure which would not only serve to protect the external corner or edge region of the package, article, product, palletized load, and the like, but in addition, could achieve levels of structural integrity and flexural strength or bending resistance which would be comparable to those of conventional external corner or edge protectors, or alternatively, wherein the amount of material that is required in connection with the manufacture or fabrication of such an external corner or edge protector would be substantially the same as that of conventional external corner or edge protectors, however, the unique and novel structure of the external corner or edge protector would enable enhanced levels of structural integrity and flexural strength or bending resistance to be achieved.

SUMMARY OF THE INVENTION

The foregoing and other objectives are achieved in accordance with the teachings and principles of the present invention through the provision of a new and improved external angleboard corner or edge protector which is fabricated from predetermined materials and which is uniquely structured. In particular, the new and improved external angleboard edge or corner protector is fabricated from high density polyethylene (HDPE), ultra-high density polyethylene (UHDPE), high molecular weight polyethylene (HMWPE), high density polypropylene (HDPP), high density polyvinylchloride (HDPVC), high density polystyrene (HDPS), high density polyethylene terephthalate (HDPET), and the like. In addition, the external corner or edge protector structurally comprises a corner or edge vertex portion, a pair of leg members which diverge outwardly at a predetermined included angle with respect to each other from the corner or edge vertex portion, and distal end portions formed upon each one of the pair of leg members, wherein the corner or edge vertex portion, and the distal end portions of the leg members have relatively enlarged cross-sectional dimensions or areas relative to the cross-sectional areas or dimensions comprising those portions of the leg members which integrally interconnect the distal end portions of the leg members to the corner or edge vertex portion.

The provision of the corner or edge vertex portion of the external corner or edge protector with the relatively enlarged cross-sectional area or dimension serves to effectively reinforce such corner or edge vertex portion of the external edge or corner protector, and in addition, the relatively enlarged distal end portions of the leg members serve to dispose only such relatively enlarged distal end portions of the leg members into contact with the external side wall members of the package, article, product, palletized load, or the like, which intersect each other so as to define the external corner or edge region of the package, article, palletized load, product, or the like upon which the external corner or edge protector is to be disposed, such that the leg members of the external corner or edge protector are flexed more than has conventionally been the case. Accordingly, forces are generated and transmitted to the corner or edge vertex portion of the new and improved external corner or edge protector, by means of moment arms which are defined by those portions of the leg members that integrally interconnect the distal end portions of the leg members to the corner or edge vertex portion of the external corner or edge protector, so as to be imparted to and impressed upon the corner or edge vertex portion of the external corner or edge protector and thereby rigidify the same. Accordingly, the corner or edge vertex portion of the new and improved external edge or corner protector will exhibit enhanced flexural strength or bending resistance properties along the axial or longitudinal extent of the corner or edge vertex portion of the new and improved external edge or corner protector.

In this manner, if the external corner or edge protector has been manufactured or fabricated from a reduced amount and weight of material as compared to conventional external corner or edge protectors, then the exhibited flexural strength and resistance values would be comparable to those characteristic of such conventional external corner or edge protectors, whereas if the external corner or edge protector has been manufactured or fabricated from an amount and weight of material which is comparable to that of conventional external corner or edge protectors, then the exhibited flexural strength and resistance values would be enhanced as compared to those characteristic of such conventional external corner or edge protectors. In either case, favorable flexural strength and resistance value/material and weight ratios can be achieved in accordance with the principles and teachings of the present invention.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 1 is a perspective view of a conventional, PRIOR ART external corner or edge protector used for covering and protecting external corner or edge portions of a package, article, product, palletized load, or the like;

DETAILED DESCRIPTION OF THE PREFERRED EMBODIMENT

Figure 1:
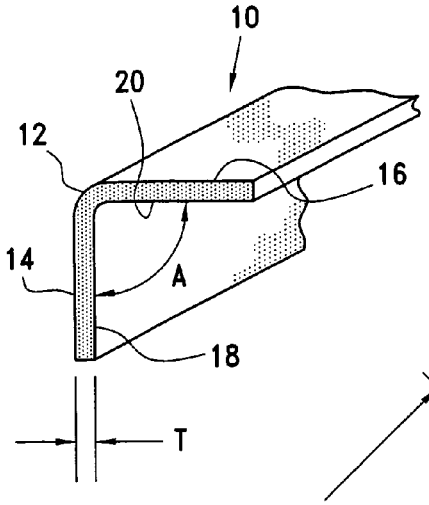
FIG. 1 (PRIOR ART)

Referring now to the drawings, and more particularly to FIG. 1 thereof, a conventional, PRIOR ART external corner or edge protector, for covering and protecting external corner or edge portions of a package, article, product, palletized load, or the like, is disclosed and is generally indicated by the reference character 10. As can be appreciated, the conventional, PRIOR ART external corner or edge protector 10 is seen to comprise a vertex portion 12 and a pair of leg members 14,16 which diverge outwardly from the vertex portion 12 at a predetermined angle A with respect to each other, such as, for example, 90°. It is also seen that the cross-sectional thickness dimension T of the external corner or edge protector 10 is substantially uniform throughout both leg members 14,16, as well as within the vertex portion 12, and it can be appreciated that when the conventional, PRIOR ART external corner or edge protector 10 is disposed around an external corner or edge region of a package, article, product, palletized load, or the like, the internal surface portions 18,20 of the leg members 14,16 will respectively be disposed in a flush, or surface-to-surface, contact mode with respect to those side wall members of the package, article, product, palletized load, or the like which intersect each other and define the corner or edge region upon which the conventional, PRIOR ART external corner or edge protector 10 is disposed. As a result of such structure characteristic of the conventional, PRIOR ART external corner or edge protector 10, the conventional, PRIOR ART external corner or edge protector 10 will exhibit predetermined flexural strength or flexural resistance property values within the vertex portion 12 thereof along the entire longitudinal or axial extent thereof.

As has been noted hereinbefore, however, it desirable, from a manufacturing or fabrication point of view or perspective, to manufacture, produce, or fabricate external corner or edge protectors from a reduced amount of material while preserving the aforenoted flexural strength or flexural resistance property values, within the vertex portion of the external corner or edge protectors, along the entire longitudinal or axial extents thereof. Alternatively, the same amount of material as used to fabricate or manufacture a conventional PRIOR ART external corner or edge protector can be utilized whereby enhanced flexural strength or flexural resistance property values, characteristic of the external edge or corner protector within the vertex portion thereof and along the entire longitudinal or axial extent, can likewise be achieved. Accordingly, with reference being made to FIG. 2, a first embodiment of a new and improved external corner or edge protector, as constructed in accordance with principles and teachings characteristic of the present invention, is disclosed and is generally indicated by the reference character 110. As was the case with the conventional, PRIOR ART external corner or edge protector 10 as disclosed within FIG. 1, the new and improved external corner or edge protector 110 as developed in accordance with the principles and teachings of the present invention is seen to comprise a vertex portion 112, and a pair of leg members 114,116 which diverge outwardly from the vertex portion 112 at a predetermined angle B with respect to each other, which may be anywhere within the range of 60°-90°, with the preferred range being 85°-90°.

Continuing further, it is to be appreciated that the entire external corner or edge protector 110 is fabricated or manufactured as a solid member and is indeed preferably manufactured or fabricated from any one of various suitable thermoplastic resins, or blends thereof, such as, for example, high density polyethylene (HDPE), ultra-high density polyethylene (UHDPE), high molecular weight polyethylene (HMWPE), high density polypropylene (HDPP), high density polyvinylchloride (HDPVC), high density polystyrene (HDPS), high density polyethylene terephthalate (HDPET), and the like. Still further, or alternatively, the external corner or edge protector 110 may be manufactured or fabricated from suitable filled polymers, that is, any one of the aforenoted polymers filled with various paper products, such as, for example, paper fiber, pulp, or shredded paper, or with various other fillers, such as, for example, talc, calcium, wollastanite, or wood products, such as, for example, saw dust, wood flour, wood chips, and the like. It is also noted that in accordance with the unique structure characteristic of this first embodiment of the external edge or corner protector 110 of the present invention, the thickness or cross-sectional dimension of each one of the leg members 114,116 has effectively been reduced to a thickness or cross-sectional dimension T-X as compared, for example, to the thickness or cross-sectional dimension T characteristic of the conventional, PRIOR ART external corner or edge protector 10 as illustrated within FIG. 1. This reduction in the thickness or cross-sectional dimension of each one of the leg members 114,116 of the external corner or edge protector 110 serves several functions and is profoundly significant.

Firstly, for example, as may readily be appreciated, by effectively reducing the thickness or cross-sectional dimension of each one of the leg members 114,116 of the external corner or edge protector 110, as compared, for example, to the thickness or cross-sectional dimension T characteristic of the conventional, PRIOR ART external corner or edge protector 10 as illustrated within FIG. 1, a substantial reduction in the raw material, required to manufacture or fabricate the external corner or edge protector 110, can be achieved, whereby, in turn, a substantial reduction in the manufacturing or fabrication costs per each external corner or edge protector 110 can be realized in a cost-effective manner. In addition, the weight of each external corner or edge protector 110 is correspondingly reduced. Secondly, which is not at all readily apparent, since the thickness or cross-sectional dimension of each one of the leg members 114, 116 of the external corner or edge protector 110 has effectively been reduced from the conventional thickness or cross-sectional dimension T to the thickness or cross sectional dimension T-X, the thickness or cross-sectional dimension of each one of the leg members 114,116 of the external corner or edge protector 110 has effectively been reduced by an amount X while the thickness or cross-sectional dimension of the vertex portion 112 of the external corner or edge protector 110, as well as the thickness or cross-sectional dimension of the respective distal end portions 122,124 of the leg members 114,116 of the external corner or edge protector 110 has remained as T.

In other words, for example, assuming that the thickness or cross-sectional dimension of each one of the leg members 114,116 of the external corner or edge protector 110 has effectively been reduced in a symmetrical manner, that is, upon both its external and internal surface portions thereof, then the respective distal end portions 122,124 of the leg members 114,116 of the external corner or edge protector 110 project inwardly and outwardly away from the respective interior surface portions 118,120 of the leg members 114,116 of the external corner or edge protector 110, as well as with respect to the exterior surface portions of the leg members 114,116 of the external corner or edge protector 110, by an amount 0.5×. It can be seen that each one of the leg members 114,116, taken in conjunction with the vertex portion 112, therefore has a cross-sectional configuration which resembles an I-beam structural member. It can therefore be correspondingly appreciated that the respective interior surface portions 118,120 of the leg members 114,116 of the external corner or edge protector 110 will be offset or set back from the external surface portions of the side wall members of the package, article, product, palletized load, or the like, which intersect each other and define the corner or edge region upon which the external corner or edge protector 110 is disposed, through means of the distance or dimension 0.5×.

In addition, it is to be further appreciated that, in order to in fact position each one of the leg members 114, 116 of the external corner or edge protector 110 upon the external surface portions of the side wall members of the package, article, product, palletized load, or the like, or viewed from an alternative point of view, in order to permit the interior surface portions of the distal end portions 122,124 of the leg members 114,116 of the external corner or edge protector 110 to actually be seated upon the external surface portions of the side wall members of the package, article, product, palletized load, or the like, each one of the leg members 114,116 of the external corner or edge protector 110 will have to be expanded outwardly with respect to each other, as denoted by the oppositely oriented arrows E,E, an additional distance of 0.5×. As a result of such laterally outward expansive movements of the leg members 114,116 of the external corner or edge protector 110 with respect to each other, compressive forces F,F are going to effectively be transmitted to the vertex portion 112 of the corner or edge protector 110 along moment arms which are effectively defined by means of the length dimensions L,L of the leg members 114, 116 of the external corner or edge protector 110, whereby such transmitted forces F,F will manifest themselves as flexural resistance forces within the vertex portion 112 of the external corner or edge protector 110 so as to effectively rigidify the vertex portion 112 of the corner or edge protector 110.

It is to be appreciated that, in accordance with well-known principles of physics, particularly Newton's Third Law of Motion, for every action or force, there is a correspondingly equal, and oppositely directed, reaction or force, and accordingly, when external forces EF are impressed upon the vertex portion 112 of the corner or edge protector 110 so as to tend to flex or bend the vertex portion 112 of the edge or corner protector 110, the flexural resistance forces F,F, rigidifying the vertex portion 112 of the corner or edge protector 110 will in fact resist such external forces EF so as to preserve the structural integrity of the corner or edge protector 110. It can therefore be appreciated further that the external corner or edge protector 110 as disclosed within FIG. 2 will exhibit flexural strength or resistance values which are comparable to the flexural strength or resistance values characteristic of the conventional PRIOR ART external corner or edge protector 10 as illustrated within FIG. 1 despite the fact that the external corner or edge protector 110 has reduced material and weight as compared to the conventional PRIOR ART external corner or edge protector 10 as illustrated within FIG. 1.

Figure 2:
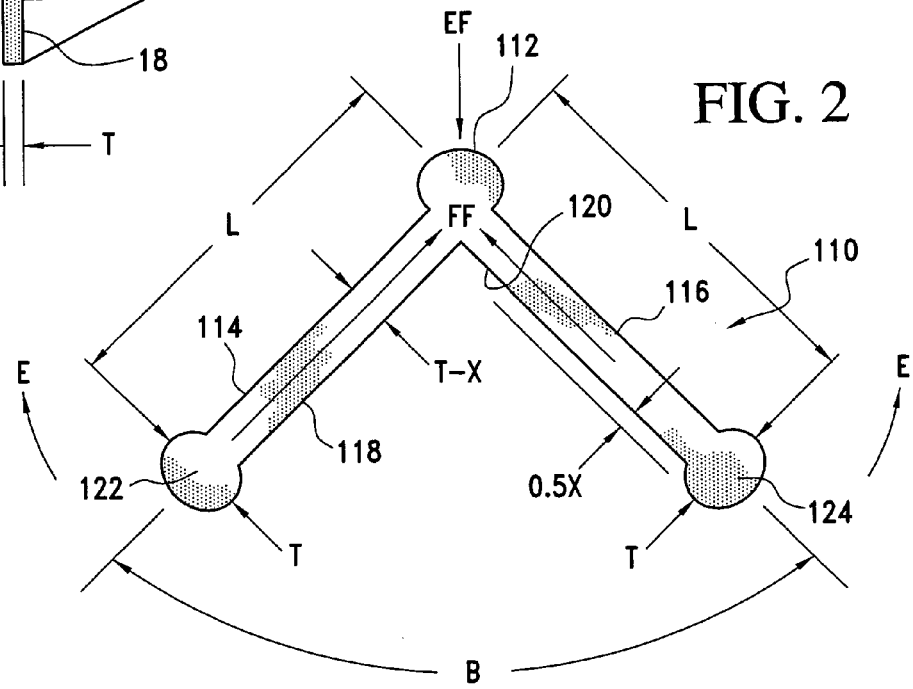
FIG. 2 is an end elevation view of a first embodiment of a new and improved external corner or edge protector, for covering and protecting external corner or edge portions of a package, article, product, palletized load, or the like, which has been constructed in accordance with the principles and teachings of the present invention and which shows the cooperative parts thereof.
Figure 3:
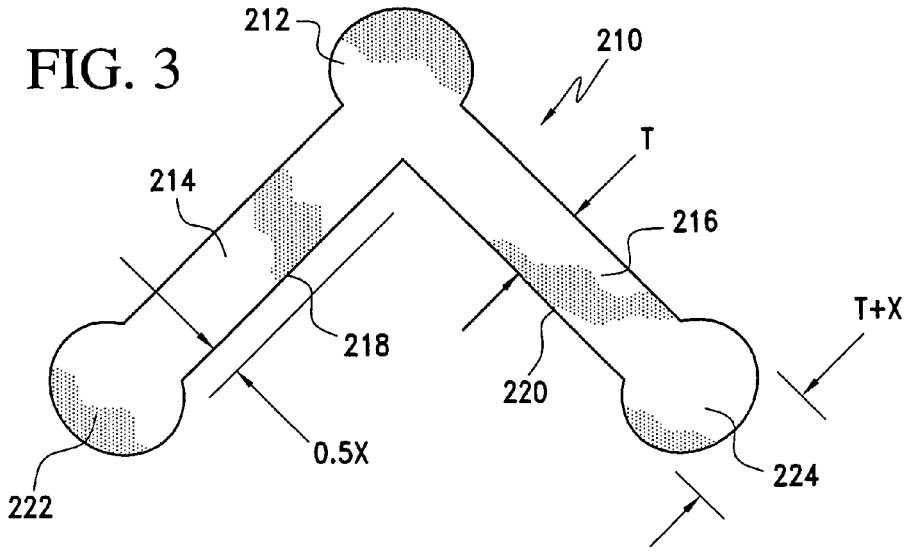
FIG. 3 is an end elevation view, similar to that of FIG. 2, showing, however, a second embodiment of a new and improved external corner or edge protector which has also been constructed in accordance with the principles and teachings of the present invention and which shows the cooperative parts thereof.

With reference being made to FIG. 3, it is seen that a second embodiment of a new and improved external corner or edge protector is disclosed and is generally indicated by the reference character 210, and it is submitted that the external corner or edge protector 210 as disclosed within FIG. 3 is substantially the same as the external corner or edge protector 110 as disclosed within FIG. 2, except as will be noted hereinafter, and therefore, the particular component parts of the external corner or edge protector 210, which correspond to the component parts of the external corner or edge protector 110, have been designated by corresponding reference characters except that they are within the 200 series. It is noted that the only significant difference between the external corner or edge protector 210, as compared to the external corner or edge protector 110, is that in lieu of the cross-sectional or thickness dimensions of the leg members 214,216 being reduced by an amount X so as to corresponding reduce the amount of material required to manufacture or fabricate the external edge or corner protector 110, and the corresponding weight of the external corner or edge protector 110, the thickness dimensions of the leg members 214,216 of the external corner or edge protector 210 have been maintained at T, so as to be comparable with the cross-sectional or thickness dimensions of the conventional, PRIOR ART external corner or edge protector 10, however, the cross-sectional or thickness dimensions of the vertex portion 212, and of the leg members 214,216, of the external corner or edge protector 210 have been increased by an amount X.

Figure 4:
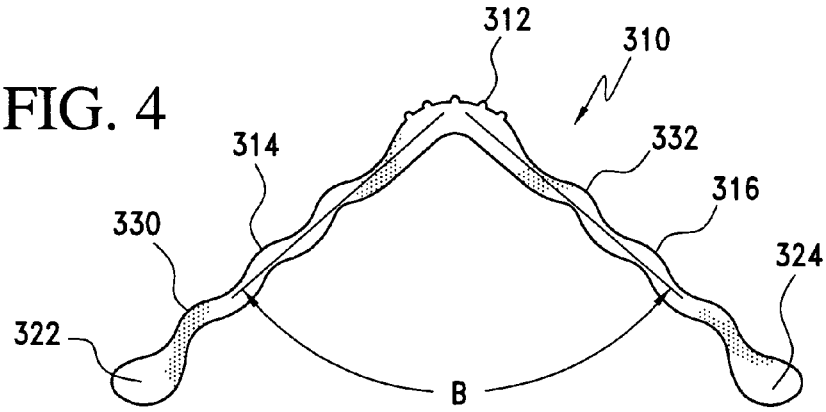
FIG. 4 is an end elevation view, similar to those of FIGS. 2 and 3, showing, however, a third embodiment of a new and improved external corner or edge protector which has been constructed in accordance with the principles and teachings of the present invention and which shows the cooperative parts thereof.
Figure 5:
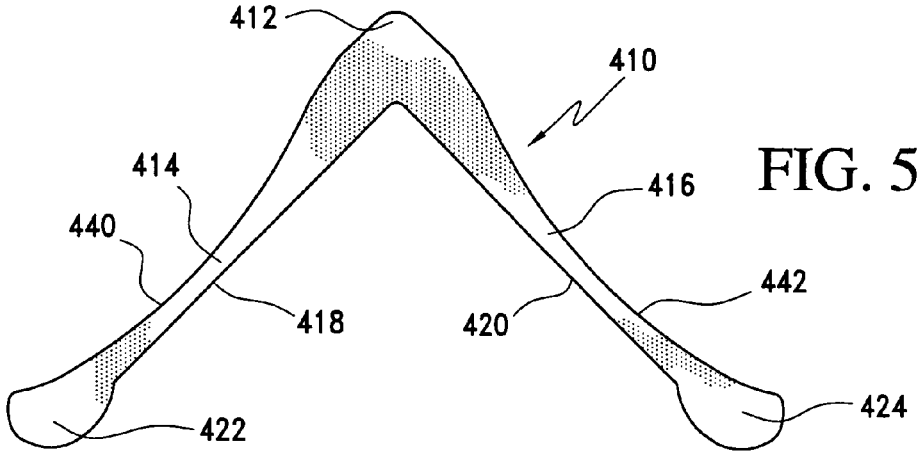
FIG. 5 is an end elevation view, similar to those of FIGS. 2-4, showing, however, a fourth embodiment of a new and improved external corner or edge protector which has been constructed in accordance with the principles and teachings of the present invention and which shows the cooperative parts thereof.

It is particularly noted that the interior surface portions 218,220 of the leg members 214,216 of the external corner or edge protector are still inwardly offset or recessed by a distance amount of 0.5×, and accordingly, similar compressive and flexural resistance forces F,F will be generated in a manner similar to that discussed in connection with the external corner or edge protector 110 as disclosed within FIG. 2. Therefore, since the size and weight of the external corner or edge protector 210 is comparable to the size and weight of the conventional, PRIOR ART external corner or edge protector 10 as illustrated within FIG. 1, the additionally generated compressive and flexural resistance forces F,F will exceed those characteristic of the conventional, PRIOR ART external corner or edge protector 10 as illustrated within FIG. 1. With reference lastly being made to FIGS. 4 and 5, additional embodiments of new and improved external corner or edge protectors, developed in accordance with the principles and teachings of the present invention, are disclosed and are respectively generally indicated by the reference characters 310,410.

It is noted, in connection with the external corner or edge protector 310 as illustrated within FIG. 4, that the only significant difference between the structure comprising the external corner or edge protector 310 as illustrated within FIG. 4, as compared to the external corner or edge protectors 110,210 as respectively illustrated within FIGS. 2 and 3, resides in the fact that the leg members 314,316 are effectively corrugated so as to be respectively provided with longitudinally or axially extending rib members 330,332. In a similar manner, in connection with the external corner or edge protector 410 as illustrated within FIG. 5, it is noted that the only significant difference between the structure comprising the external corner or edge protector 410 as illustrated within FIG. 5, as compared to the external corner or edge protector 110 as, for example, illustrated within FIG. 2, resides in the fact that in order to effectively reduce the material and weight of the external corner or edge protector 410 in a manner similar to that of the external corner or edge protector 110 as illustrated within FIG. 2, the leg members 414,416 respectively have arcuately shaped external surface portions 440,442. It is of course to be appreciated that the internal surface portions 418,420 could likewise be arcuately configured, and it is lastly noted that while the distal end portions 122,124,222, 224,322,324,422,424 of all of the external corner or edge protectors 110,210,310,410 have rounded configurations, other configurations of such distal end portions 122,124,222,224, 322,324,422,424 are of course possible.

Figure 6:
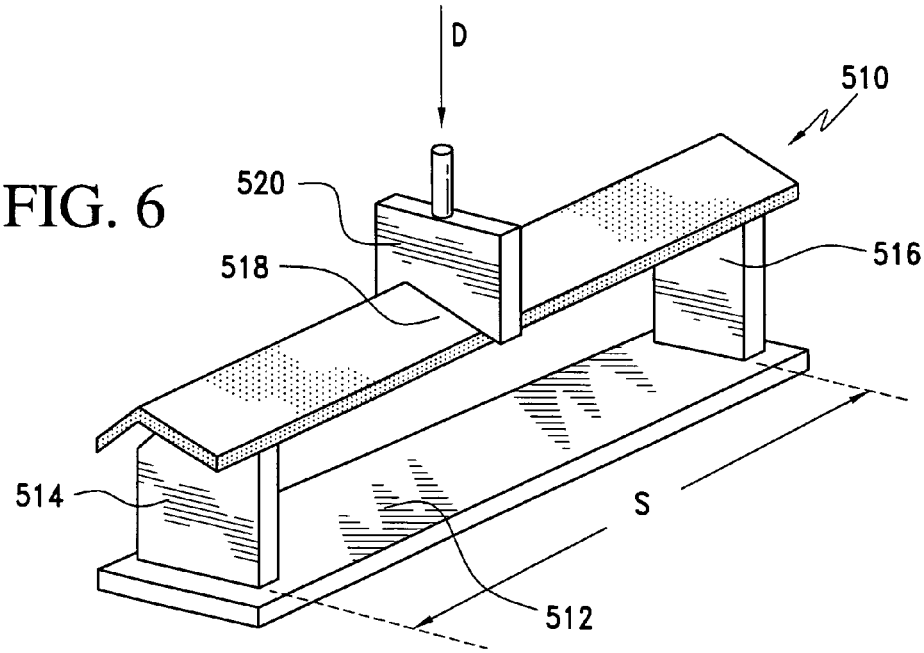
FIG. 6 is a schematic diagram illustrating testing apparatus for testing external corner or edge protectors in order to determine their flexural strength and resistance properties with respect to forces applied perpendicular to the axial or longitudinal extent thereof at a central location along the vertex portion thereof.

With reference lastly being made to FIG. 6, a testing apparatus or system is disclosed for imparting flexural or bending forces to external corner or edge protectors in order to in fact test and determine their flexural resistance properties. The testing apparatus or system is generally indicated by the reference character 510 and is seen to comprise a fixed support which comprises a base member 512, and a pair of upstanding support blocks 514,516 which are fixedly mounted upon the upper surface portion of the base member 512 so as to be disposed adjacent to the opposite ends of the base member 512. The support blocks 514,516 are spaced a predetermined distance S apart from each other, which in this case was twenty inches (20"), and it is noted that the upper surface portions of the support blocks 514,516 are angled in the form of a residential roof so as to be capable of having an external corner or edge protector seated thereon.

An external corner or edge protector 518, which may correspond to any one of the external corner or edge protectors 10,110,210, 310,410 as respectively illustrated within FIGS. 1-5, and which has a length dimension of twenty-four inches (24"), is then disposed atop the support blocks 514, 516, and a force applicator block 520 is then moved downwardly into contact with the external corner or edge protector 518, at an axially central portion thereof, so as to impress a flexural force thereon. The force applicator block 520 is moved downwardly in the direction D at a speed of fifteen and three-quarters inches/minute (15.75"/min.) until the tested external corner or edge protector specimen fails. Test results conducted upon the conventional, PRIOR ART external corner or edge protector 10, as illustrated in FIG. 1, are noted as Specimen 1 in the following Table, while test results conducted upon the external corner or edge protector 210, as illustrated in FIG. 3, are noted as Specimens 2 and 3 in the following Table, the only difference between Specimens 2 and 3 resides in the lengths L of the leg members 214, 216, in particular, the length L of the leg members 214,216 of Specimen 2 was approximately two and one-quarter inches (2.25"), while the length L of the leg members 214,216 of Specimen 3 was approximately two and one-half inches (2.50").

TABLE

Three-Point Flexural Bend Test Results

| | Applied Force (Pounds) | Maximum Vertical Displacement Before Failure (Inches) |
|---|---|---|
| Specimen 1 | 246.0 | 0.41 |
| Specimen 2 | 288.9 | 0.40 |
| Specimen 3 | 330.9 | 0.38 |

Accordingly, it may be seen that in accordance with the principles and teachings of the present invention, and as verified by means of the above test results, there has been developed a new and improved external corner or edge protect- or which exhibits very favorable flexural strength or resistance properties as a function of the dimensions and weight thereof. In particular, it is seen, for example, as noted from the above Table, that both of the external corner or edge protector Specimens 2 and 3, constructed in accordance with the principles and teachings of the present invention, exhibited similar flexural or bending displacements as that of the conventional, PRIOR ART external corner or edge protector Specimen 1, however, such external corner or edge protector Specimens 2 and 3 were capable of withstanding applied forces which were approximately forty-three percent (43%) and eighty-four percent (84%), respectively, greater than the force which the conventional, PRIOR ART Specimen 1 was capable of withstanding before exhibiting failure. It is lastly noted that the external corner or edge protector Specimen 3 exhibited greater flexural resistance properties than those of the external corner or edge protector Specimen 2 because the longer leg members of the external corner or edge protector Specimen 3 results in longer moment arms along which the compressive forces to the vertex portion are transmitted.

Thus, it may be seen that in accordance with the principles and teachings of the present invention, there has been disclosed and described a new and improved external angle-board corner or edge protector which is fabricated from predetermined materials and which is uniquely structured wherein the external corner or edge protector structurally comprises a corner or edge vertex portion, a pair of leg members which diverge outwardly at a predetermined included angle with respect to each other from the corner or edge vertex portion, and distal end portions formed upon each one of the pair of leg members. The corner or edge vertex portion, and the distal end portions of the leg members, have relatively enlarged cross-sectional dimensions or areas relative to the cross-sectional areas or dimensions comprising those portions of the leg members which integrally interconnect the distal end portions of the leg members to the corner or edge vertex portion. The provision of the corner or edge vertex portion of the external corner or edge protector with the relatively enlarged cross-sectional area or dimension serves to effectively reinforce such corner or edge vertex portion of the external edge or corner protector, while in addition, the relatively enlarged distal end portions of the leg members serve to dispose only such relatively enlarged distal end portions of the leg members into contact with the external side wall members of the package, article, product, palletized load, or the like, which intersect each other so as to define the external corner or edge region of the package, article, palletized load, product, or the like upon which the external corner or edge protector is to be disposed, such that the leg members of the external corner or edge protector are flexed more than has conventionally been the case.

Accordingly, forces are generated and transmitted to the corner or edge vertex portion of the new and improved external corner or edge protector, by means of moment arms which are defined by those portions of the leg members that integrally interconnect the distal end portions of the leg members to the corner or edge vertex portion of the external corner or edge protector, so as to be imparted to and impressed upon the corner or edge vertex portion of the external corner or edge protector and thereby rigidify the same. In this manner, the corner or edge vertex portion of the new and improved external edge or corner protector will exhibit enhanced flexural strength or bending resistance properties along the axial or longitudinal extent of the corner or edge vertex portion of the new and improved external edge or corner protector when external forces are impressed thereon tending to flex or bend the external edge or corner protector. Therefore, if the external corner or edge protector has been manufactured or fabricated from a reduced amount and weight of material as compared to conventional external corner or edge protectors, then the exhibited flexural strength and resistance values would be comparable to those characteristic of such conventional external corner or edge protectors, whereas if the external corner or edge protector has been manufactured or fabricated from an amount and weight of material which is comparable to that of conventional external corner or edge protectors, then the exhibited flexural strength and resistance values would be enhanced as compared to those characteristic of such conventional external corner or edge protectors. In either case, favorable flexural strength and resistance value/material and weight ratios can be achieved in accordance with the principles and teachings of the present invention.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. An external corner edge protector for protecting an external corner edge portion of an article when said external corner edge protector is disposed around the external corner edge portion of the article, comprising:

a vertex portion having an internal corner region and an external corner region; and a pair of leg members, having internal and external surface portions, integrally connected together at proximal portions thereof by said vertex portion;

wherein said pair of leg members further comprise distal end portions which are disposed remote from said vertex portion and which comprise enlarged cross-sectional thickness dimensions, relative to the cross-sectional thickness dimensions of those portions of said pair of leg members which interconnect said distal end portions of said pair of leg members to said vertex portion, such that sections of said distal end portions of said pair of leg members will project inwardly away from said internal surface portions of said pair of leg members and toward the side surfaces of the article, which intersect each other so as to define the external corner edge portion of the article around which said external corner edge protector is to be disposed, whereby only said enlarged distal end portions of said external corner edge protector, in addition to said internal corner region of said vertex portion, will engage the side surfaces of the article when said external corner edge protector is mounted upon the external corner edge portion of the article such that said pair of leg members will be forced outwardly away from each other, by a predetermined distance, so as to generate forces which are transmitted to said vertex portion of said external corner edge protector in order to rigidify said vertex portion of said external corner edge protector against externally applied flexural bending forces.

2. An external corner edge protector for protecting an external corner edge portion of an article when said external corner edge protector is disposed around the external corner edge portion of the article, comprising:

a vertex portion having an internal corner region and an external corner region; and a pair of leg members, having internal and external surface portions, integrally connected together at proximal portions thereof by said vertex portion;

wherein said pair of leg members further comprise distal end portions which are disposed remote from said vertex portion and which comprise enlarged cross-sectional thickness dimensions relative to the cross-sectional thickness dimensions of said pair of leg members interconnecting said distal end portions of said pair of leg members to said vertex portion such that sections of said distal end portions of said pair of leg members will project inwardly away from said internal surface portions of said pair of leg members and toward the side surfaces of the article, which intersect each other so as to define the external corner edge portion of the article around which said external corner edge protector is to be disposed, whereby, when said external corner edge protector is mounted upon the external corner edge portion of the article, said pair of leg members will be forced outwardly away from each other, through a predetermined distance, such that only said enlarged distal end portions of said external corner edge protector, in addition to said internal corner region of said vertex portion, will engage the side surfaces of the article, as a result of which, forces will be generated within said pair of leg members and transmitted to said vertex portion of said external corner edge protector in order to rigidify said vertex portion of said external corner edge protector against externally applied flexural bending forces whereby said external corner edge protector will exhibit flexural bending resistance properties.

3. The external corner edge protector as set forth in claim 1, wherein:

said external corner edge protector is fabricated from a thermoplastic resin selected from the group comprising high density polyethylene (HDPE), ultra-high density poly-ethylene (UHDPE), high molecular weight polyethylene (HMWPE), high density polypropylene (HDPP), high density polyvinyl-chloride (HDPVC), high density polystyrene (HDPS), and high density polyethylene terephthalate (HDPET).

4. The external corner edge protector as set forth in claim 3, wherein:

said external corner edge protector is fabricated from a filled polymer, comprising any one of said thermoplastic resins, filled with materials selected from the group comprising paper fiber, pulp, shredded paper, talc, calcium, wollastanite, saw dust, wood flour, and wood chips.

5. The external corner edge protector as set forth in claim 1, wherein:

said pair of leg members are disposed at a predetermined included angle, with respect to each other, which is within the range of 60°-90°.

6. The external corner edge protector as set forth in claim 5, wherein:

said pair of leg members are disposed at a predetermined included angle, with respect to each other, which is within a preferred range of 86°-90°.

7. The external corner edge protector as set forth in claim 1, wherein:

said enlarged cross-sectional thickness dimensions characteristic of said distal end portions of said pair of leg members, relative to said cross-sectional thickness dimensions of those portions of said pair of leg members which interconnect said distal end portions of said pair of leg members to said vertex portion, comprise a reduction in said cross-sectional thickness dimension of each one of said pair of leg members so as to minimize material costs for fabricating said external corner edge protector while preserving said flexural bending resistance forces at levels comparable to external corner edge protectors not having said reduced cross-sectional thickness dimensions.

8. The external corner edge protector as set forth in claim 1, wherein:

said enlarged cross-sectional thickness dimensions characteristic of said distal end portions of said pair of leg members, relative to said cross-sectional thickness dimensions of those portions of said pair of leg members which interconnect said distal end portions of said pair of leg members to said vertex portion, comprise an enlargement in said cross-sectional thickness dimensions of said distal end portions of said pair of leg members beyond a predetermined cross-sectional thickness dimension characteristic of those portions of said pair of leg members which interconnect said distal end portions of said pair of leg members to said vertex portion of said external corner edge protector so as to effectively preserve material costs for fabricating said external corner edge protector while enhancing said flexural bending resistance forces to levels beyond those characteristic of external corner edge protectors not having said enlarged cross-sectional thickness dimensions.

9. The external corner edge protector as set forth in claim 1, wherein:

each one of said pair of leg members of said external corner edge protector has rib members extending throughout the longitudinal extent thereof.

10. The external corner edge protector as set forth in claim 1, wherein:

each one of those portions of said pair of leg members which interconnect said distal end portions of said pair of leg members to said vertex portion of said external corner edge protector has a substantially arcuate cross-sectional configuration.

11. The external corner edge protector as set forth in claim 1, wherein:

each one of those portions of said pair of leg members which interconnect said distal end portions of said pair of leg members to said vertex portion of said external corner edge protector has a substantially linear cross-sectional configuration.

12. The external corner edge protector as set forth in claim 2, wherein:

said external corner edge protector is fabricated from a thermoplastic resin selected from the group comprising high density polyethylene (HDPE), ultra-high density polyethylene (UHDPE), high molecular weight polyethylene (HMWPE), high density polypropylene (HDPP), high density polyvinylchloride (HDPVC), high density polystyrene (HDPS), and high density polyethylene terephthalate (HDPET).

13. The external corner edge protector as set forth in claim 12, wherein:

said external corner edge protector is fabricated from a filled polymer, comprising any one of said thermoplastic resins, filled with materials selected from the group comprising paper fiber, pulp, shredded paper, talc, calcium, wollastanite, saw dust, wood flour, and wood chips.

14. The external corner edge protector as set forth in claim 2, wherein:

said pair of leg members are disposed at a predetermined included angle, with respect to each other, which is within the range of 60°-90°.

15. The external corner edge protector as set forth in claim 14, wherein:

said pair of leg members are disposed at a predetermined included angle, with respect to each other, which is within a preferred range of 86°-90°.

16. The external corner edge protector as set forth in claim 2, wherein:

said enlarged cross-sectional thickness dimensions characteristic of said distal end portions of said pair of leg members, relative to said cross-sectional thickness dimensions of those portions of said pair of leg members which interconnect said distal end portions of said pair of leg members to said vertex portion, comprise a reduction in said cross-sectional thickness dimension of each one of said pair of leg members so as to minimize material costs for fabricating said external corner edge protector while preserving said flexural bending resistance forces at levels comparable to external corner edge protectors not having said reduced cross-sectional thickness dimensions.

17. The external corner edge protector as set forth in claim 2, wherein:

said enlarged cross-sectional thickness dimensions characteristic of said distal end portions of said pair of leg members, relative to said cross-sectional thickness dimensions of those portions of said pair of leg members which interconnect said distal end portions of said pair of leg members to said vertex portion, comprise an enlargement in said cross-sectional thickness dimensions of said distal end portions of said pair of leg members beyond a predetermined cross-sectional thickness dimension characteristic of those portions of said pair of leg members which interconnect said distal end portions of said pair of leg members to said vertex portion of said external corner edge protector so as to effectively preserve material costs for fabricating said external corner edge protector while enhancing said flexural bending resistance forces to levels beyond those characteristic of external corner edge protectors not having said enlarged cross-sectional thickness dimensions.

18. The external corner edge protector as set forth in claim 2, wherein:

each one of said pair of leg members of said external corner edge protector has rib members extending throughout the longitudinal extent thereof.

19. The external corner edge protector as set forth in claim 2, wherein:

each one of those portions of said pair of leg members which interconnect said distal end portions of said pair of leg members to said vertex portion of said external corner edge protector has a substantially arcuate cross-sectional configuration.

20. The external corner edge protector as set forth in claim 2, wherein:

each one of those portions of said pair of leg members which interconnect said distal end portions of said pair of leg members to said vertex portion of said external corner edge protector has a substantially linear cross-sectional configuration.

* * * * *